United States Patent [19]

Nagase et al.

[11] Patent Number: 4,519,371

[45] Date of Patent: May 28, 1985

[54] MOUNTING DEVICE FOR FUEL INJECTION NOZZLES FOR INTERNAL COMBUSTION ENGINES

[75] Inventors: Hidenobu Nagase; Shigeru Suzuki; Shinichi Shimada, all of Saitama, Japan

[73] Assignee: Honda Giken Kogyo Kabushiki Kaisha, Tokyo, Japan

[21] Appl. No.: 438,919

[22] Filed: Nov. 3, 1982

[30] Foreign Application Priority Data

Nov. 4, 1981 [JP] Japan ..... 56-175616
Nov. 4, 1981 [JP] Japan ..... 56-163803[U]

[51] Int. Cl.[3] ..... F02M 55/00
[52] U.S. Cl. ..... 123/470
[58] Field of Search ..... 123/470, 471, 468, 469

[56] References Cited

U.S. PATENT DOCUMENTS

| | | | |
|---|---|---|---|
| 3,605,703 | 9/1971 | Moulds | 123/470 |
| 3,776,209 | 12/1973 | Wertheimer et al. | 123/470 |
| 3,841,277 | 10/1974 | Schafer | 123/470 |
| 3,857,573 | 12/1974 | Pugh | 277/102 |
| 3,993,030 | 11/1976 | Jaulmes | 123/470 |
| 4,066,213 | 1/1978 | Stampe | 123/470 |
| 4,201,172 | 5/1980 | Jaggle et al. | 123/470 |
| 4,307,693 | 12/1981 | Glockler et al. | 123/470 |
| 4,327,690 | 4/1982 | Sauer et al. | 123/468 |

FOREIGN PATENT DOCUMENTS

| | | | |
|---|---|---|---|
| 2208646 | 8/1973 | Fed. Rep. of Germany | 123/470 |
| 2827850 | 1/1980 | Fed. Rep. of Germany . | |
| 687248 | 9/1979 | U.S.S.R. | 123/470 |

*Primary Examiner*—Magdalen Y. C. Moy
*Attorney, Agent, or Firm*—Lyon & Lyon

[57] ABSTRACT

A device for mounting fuel injection systems and particularly fuel injection nozzles and a fuel supply manifold. The device includes U-shaped structures having coaxial, spaced holes into which are mounted fuel injection nozzles. The fuel supply manifold is fixed to the structure such that it is in alignment with the nozzles to provide fuel thereto. The nozzles are mounted and sealed by resilient members positioned and compressed within the coaxial holes to provide vibration isolation, thermal isolation and accommodation of dimensional control anomolies in what is therefore allowed to be crudely fabricated components.

10 Claims, 10 Drawing Figures

MOUNTING DEVICE FOR FUEL INJECTION NOZZLES FOR INTERNAL COMBUSTION ENGINES

BACKGROUND OF THE DISCLOSURE

The field of the present invention is fuel injection systems, and more particularly, devices for mounting injector nozzles for such fuel injection systems.

Fuel injection systems generally employ nozzles which are fixed relative to the engine at either the intake manifold or the cylinder head to direct fuel received from a fuel distribution line toward the intake of the engine cylinders at appropriately timed intervals. Such nozzles are usually comprised of a solenoid valve arranged to inject in an intermittent manner the fuel supplied thereto through the fuel distribution line. The nozzle is directed to provide fuel toward the combustion chamber in the engine cylinder, often indirectly via the intake manifold.

Mounting devices for mounting injector nozzles on engines have previously been employed which include a pipe joint such as a nipple for joining the injection nozzle to the fuel distribution line and a means for directly affixing the nozzle to an engine element such as the cylinder head or the intake manifold. Such mounting devices often require close machining tolerances and close mounting tolerances in order to maintain an appropriate seal at the joints between the injection nozzles and the fuel distribution line and also between the injection nozzles and the engine.

The requirement for close tolerances and effective seals is often the result of the difficult environment in which the injection nozzle is located. The nozzle itself vibrates during the injecting operation. This vibration is transmitted to the joints with the engine and with the fuel distribution line causing undesirable loosening of the joints. Fuel is thus able to leak between components. Furthermore, with standard mounting systems, the injection nozzle as well as the fuel distribution line can easily become overheated from the engine. This is particularly true in a counterflow type engine in which the intake manifold is arranged above the exhaust manifold where heat convection adds to the adverse thermal environment. As a result, the fuel may partially vaporize to create adverse operating conditions.

SUMMARY OF THE INVENTION

The present invention is directed to a device for mounting a fuel injection system to an engine, whether it be to the cylinder head itself, the intake manifold or other element of the engine. Accordingly, a mounting structure is provided to which is mounted one or more fuel injection nozzles and a fuel supply manifold. With the employment of this structure, the vibrating nozzles are positively mounted between the engine and the fuel supply manifold, yet vibrations from the nozzles are isolated. Additionally, positive sealing and heat insulation is afforded by means of the device of the present invention. Lastly, the foregoing is accomplished without the need for close tolerance machining and other expensive processes.

To effect the foregoing, a mounting structure is employed which includes two mounting points for an injector nozzle. These mounting points include seals which, because of their resiliency, provide vibration isolation and thermal isolation from the engine, the fuel flow manifold and even the mounting structure itself.

These seals are designed to be placed in compression with the assembly of the system. Additional aspects of the present invention also provide such advantageous features as self-adjusting orientation of the nozzle within the mounting structure as the system is assembled and the seals compressed, a simple construction, an assembly of a plurality of nozzles which can be collectively removed or positioned on an engine, and thermal shielding of the nozzles.

Accordingly, it is an object of the present invention to provide an improved mounting device for a fuel injection system and particularly for the nozzles and the fuel supply manifold. Other and further objects and advantages will appear hereinafter.

DETAILED DESCRIPTION OF THE PREFERRED EMBODIMENT

Figure 1:
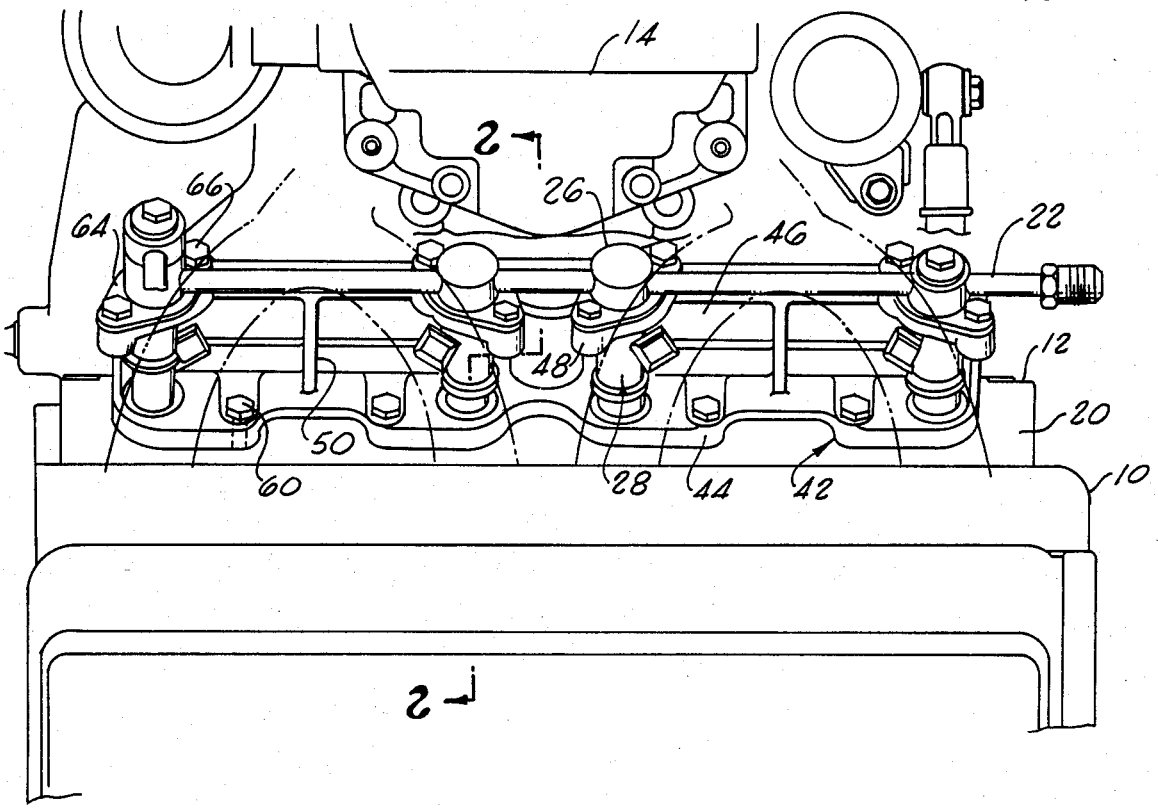
FIG. 1 is a top plan view illustrating a mounting device for fuel injection nozzles on an engine, according to one embodiment of the present invention.

A device is disclosed for the mounting of fuel injection nozzles and a fuel supply manifold for the injection nozzles on an engine. A first embodiment of this device is illustrated in FIGS. 1-5. Specifically in FIGS. 1 and 2, the device of the present invention is illustrated in association with an engine. The engine is illustrated as employing a cylinder head 10, an intake manifold 12, an intake system 14 and a cylinder block 16 in a substantially conventional arrangement. A four-cylinder engine is illustrated with the intake passages in FIG. 1 illustrated in broken line. A fuel injection nozzle port 18 is illustrated as extending through the intake manifold 12 and partially through the cylinder housing 10. Naturally, this port may be rearranged to accommodate the characteristic of the particular injection system. An extended boss 20 provides a mounting surface on the engine for the injector system. Naturally, this provision for mounting of the injector system may be provided on the intake manifold, the cylinder head or elsewhere on the engine where convenient.

A fuel supply manifold system is illustrated for supplying pressurized fuel to the injectors. This manifold includes a pipe 22 directing fuel to individual fuel passages 24 contained within fixtures 26. Four such passages 24 are provided in four fixtures 26 to serve each of the four cylinders in the present embodiment.

Figure 4:
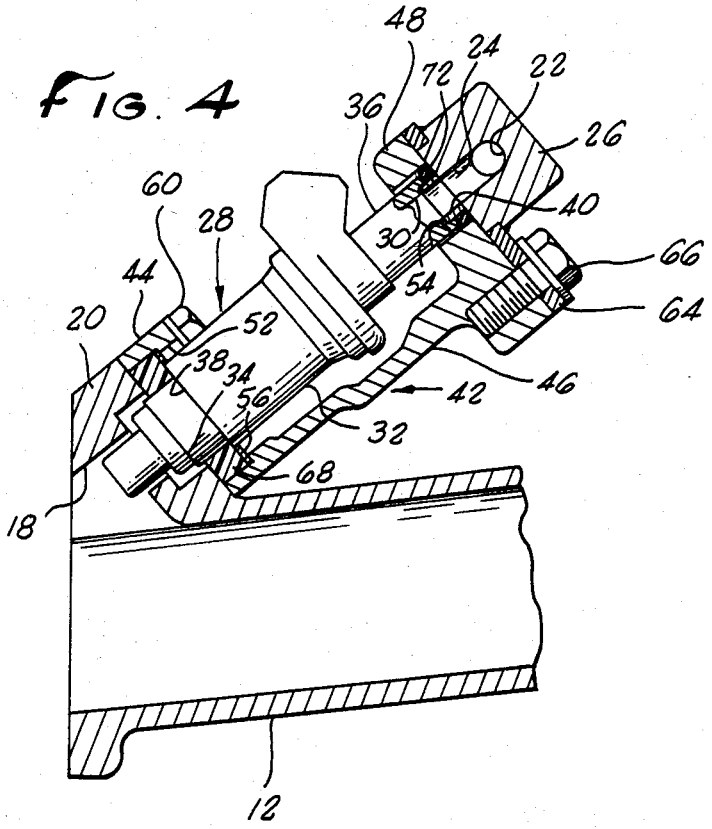
FIG. 4 is a fragmentary side view, partially broken away, illustrating the mounting of a fuel injection nozzle.

The fuel injection nozzles 28, as can best be seen in FIG. 4 are of the type having a passageway 30 extending therethrough. This passageway is controlled by a solenoid valve contained within the nozzle 28 which may be electrically energized and de-energized by a conventional driving circuit. Through the operation of the solenoid valve, fuel from the pressurized pipe 22 is appropriately injected on an intermittent basis into the engine.

The physical structure of each nozzle includes a main body portion 32 with a first, lower end 34 and a second, upper end 36. The body and the ends generally form cylindrical segments. Between the main body portion 32 and the end portion 34 a stepped reduction in diameter is included forming a shoulder 38. The shoulder 38 is generally perpendicular to the axis of the nozzle 28 and faces in a direction toward the fuel injection port 18 away from the center of the nozzle 28. At the other end of the nozzle 28, a shoulder is provided at the end of upper end portion 36. A tubular member 40 is rigidly fixed within the end of the upper end portion 36 and extends outwardly past the end shoulder of the nozzle 28.

Figure 2:
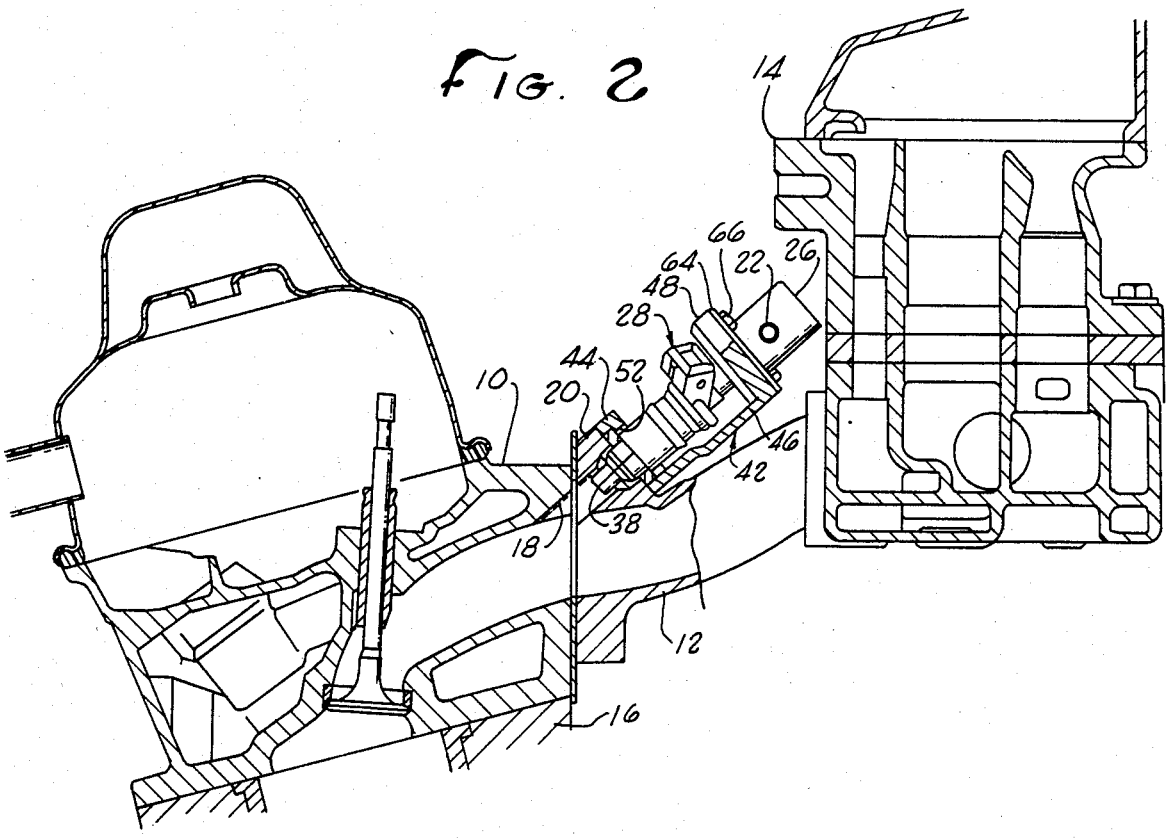
FIG. 2 is a fragmentary vertical sectional view taken along line 2—2 of FIG. 1.
Figure 3:
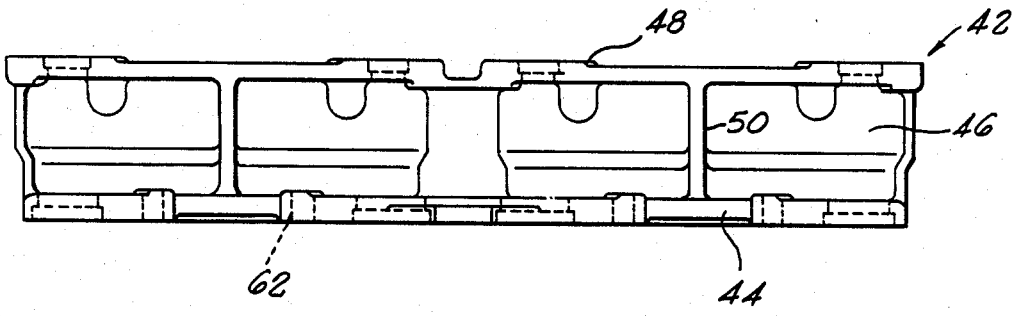
FIG. 3 is a front view illustrating a mounting structure forming part of the device of FIG. 1.

The device for mounting the fuel injection nozzles 28 and the fuel supply manifold including the fittings 28 includes a rigid mounting structure, generally designated 42. The mounting structure 42 includes a base 44, an upstanding body 46 and a mounting flange 48. The mounting flange 48 may extend the length of the mounting structure 42 or may extend outwardly from the upstanding body at particular locations to accommodate the mounting of the injector nozzles 28 as typically illustrated in FIG. 1. The mounting flange or flanges 48 extend parallel to the base 44 and are spaced therefrom. Connecting the base 44 and the mounting flange 48 is the upstanding body portion 46. A generally U-shaped configuration is thus defined in which the nozzle 28 can be positioned as seen in FIGS. 2 and 4. Additional strengthening elements 50 (FIGS. 1 and 3) may be provided where beneficial or necessary.

Figure 6:
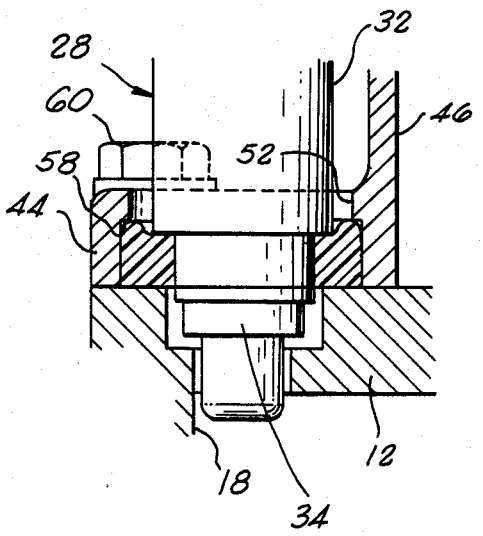
FIG. 6 is a cross-sectional elevation in detail of a seal ring in a deformed state but without the sealing ring or washer of the device of FIG. 4.

The base 44 includes a hole 52 therethrough for each nozzle 28. The mounting flange 48 also includes a hole 54 therethrough, the holes 52 and 54 being coaxial and spaced apart. Both holes 52 and 54 are larger in diameter than the relevant portions of the nozzle 28. The spacing is designed such that the lower end 34 of the nozzle will extend through the hole 52 and the upper end of the nozzle 36 will extend into the hole 54. The hole 52 includes a first shoulder between two diameters of the hole. This first shoulder is in a plane perpendicular to the axis of the hole 52 and is facing away from the hole 54. The shoulder may be defined, for example, as illustrated in either FIG. 4 or FIG. 6. In FIG. 4, a washer 56 abutts against the step in diameters to form a wide shoulder. In FIG. 6, such a washer is not present but a shoulder 58 is provided. The upper hole 54 is conveniently uniform throughout its length.

A first attachment means is employed to fix the mounting structure 42 to the engine. This means includes fasteners 60 which are threaded into the engine through the base 44, through holes 62 being provided for that purpose. A second attachment means is provided for fixing the fuel supply manifold and particularly the fixtures 26 to the mounting structure 42. This means includes attachment flanges 64 which are permanently fixed to the fixtures 26 and are held to the mounting flange 48 by fasteners 66. In both the case of the engine mounting and the fixture mounting, the holes 52 and 54 are larger in diameter than the corresponding passageways 18 and 24. Thus, at the interface between the mounting structure 42 and each of the engines and the fixtures 26, a shoulder is defined facing toward the fuel injection nozzle 28.

Figure 5:
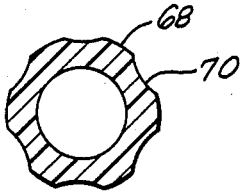
FIG. 5 is a cross-sectional view illustrating a first sealing member forming part of the device of FIG. 1.

To seal the engine at the fuel injection port 18, and to resiliently mount the fuel injection nozzle 28, a first seal 68 is employed as shown in plan in FIG. 5. This seal 68 is positioned between the shoulder provided by the engine and the shoulder provided by the washer 56 as configured in FIG. 4. The seal 68 is also positioned around a first diameter of the end 34 of the nozzle 28 such that it abutts against the lower mounting surface 38. The fit between the seal 68 and the fuel injection nozzle 28 is preferably one of interference for positive mounting and convenience of assembly. Additionally, it is preferred that an interference fit exist between the seal 68 and the surrounding hole 52 in which the seal is located. This again aids in assembly and positive mounting. Recesses 70 are provided about the periphery of the seal 68 and accommodate some deformation of material in the constrained environment of the seal 68. The seal 68 is also longer in axial length than the distance from the shoulder, in the case of FIG. 4 defined by washer 56, and the end of the mounting structure 42. Thus, when the mounting structure 42 is assembled with the engine, and the fasteners 60 are forced into position, the seal 68 will become compressed. The washer 56 aids in insuring a proper uniform deformation of the seal 68 under such compression. Additionally, the seal 68 moves against the mounting surface 38 to fix in a resilient manner the location of the nozzle 28.

At the upper end of the fuel injection nozzle 28 a seal is provided to contain the pressurized fuel distributed from the fuel supply manifold. In the preferred embodiment, this seal is provided by an O-ring 72 fixed between the fixture 26 and the shoulder defined on the end 36 of the fuel injection nozzle 28. The O-ring 72 cooperates with the tubular member 40 fixed in the end 36. Unlike the seal 68, the O-ring 72 is preferably sized so as to not be in interference fit with either the tubular member 40 or the surrounding hole 54 through the mounting structure 42. However, the O-ring 72 is larger in axial dimension than the protruding portion of the tubular member 40. Thus, when positioned, the O-ring 72 will be placed in compression against the surfaces to be sealed against escaping fuel. The O-ring 72 also provides resilient mounting to isolate the vibration of the fuel injection nozzle 28 from the remainder of the system.

To position the fuel injection nozzle 28, the upper end 36 is positioned through the upper hole 54 located in the mounting flange 48. The lower end 34 of the nozzle 28 is then positioned through the lower hole 52. The washer 56 and the seal 68 are next positioned as is the O-ring 72. The fixture 26 is then fixed to the mounting flange 48 by means of the fasteners 66. Lastly, the entire assembly is positioned on the engine and fixed thereto by means of fasteners 60. This operation, and particularly the last step, results in the compression of the seals 68 and 72. As the seal 68 is compressed against the engine under the force of the fasteners 60, the seal 68 forces the nozzle 28 upwardly to compress the O-rings 72. The O-ring compression is controlled by means of the tubular member 40 abutting against the mounting surface of the fixture 26. This also fixes the compression of the nozzle 28 against the lower seal 68.

Because the diameters of the holes 52 and 54 are larger than the corresponding end portions 34 and 36 of the fuel injection nozzle 28, only resilient contact is established between the fuel injection nozzle 28 and the mounting structure 42. Vibration transmission is thus minimized and damped. The clearances also result in far less rigorous machining requirements. Anomolies in component dimensions are conveniently compensated for by the compression of one or both of the seals 68 and 72.

As referred to above, the mounting mechanism of the present invention not only provides vibration isolation but also provides thermal isolation as well. The seal members 68 and 72 are of common resilient material which by and large exhibit low thermal conductivity. Additionally, the nozzles and the fuel supply manifold are shielded from direct radiation from the manifolds and the cylinder head. The upstanding body portion 46 of the mounting structure 42 along with the base 44 provide such shielding. The present arrangement also has advantage because the entire assembly may be prefabricated prior to final assembly with the engine.

Figure 7:
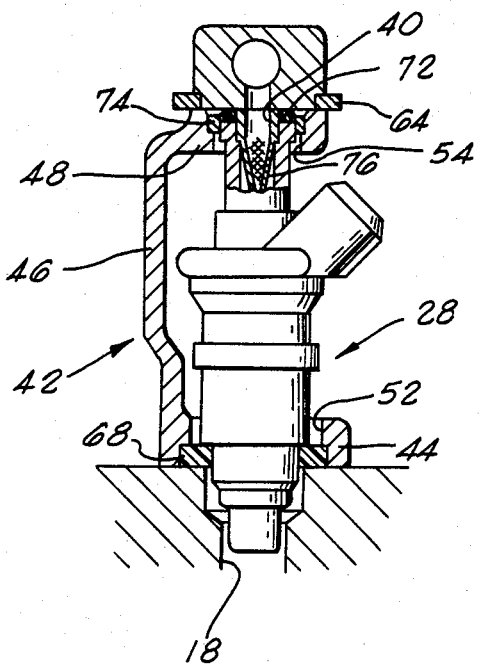
FIG. 7 is a fragmentary side view, partially broken away, illustrating a second embodiment of the device of FIG. 1.

Turning then to certain of the other embodiments, FIG. 7 illustrates a modification designed primarily for reduction in thermal conductivity resulting in heating of the earlier embodiment are labelled with reference numerals corresponding to the first embodiment where identical. However, two changes are presented to improve thermal isolation. First, the mounting structure itself is shown to be formed of ceramic material. Ceramic materials generally provide exceptional thermal isolation and such an advantage would be provided here. Secondly, a metallic collar 74 is fitted in a somewhat larger upper hole 54 through the mounting flange 48. The collar 74 acts to protect the ceramic material from injury at the interface with the nozzle during insertion and the like.

FIG. 7 also illustrates the employment of a filter 76 which is shown to be integrally formed with the tubular member 40. The filter 76 has a hollow conical configuration and extends downwardly into the nozzle 28. The filtering material may be gauze or other suitable material which can be periodically changed as required.

Figure 8:
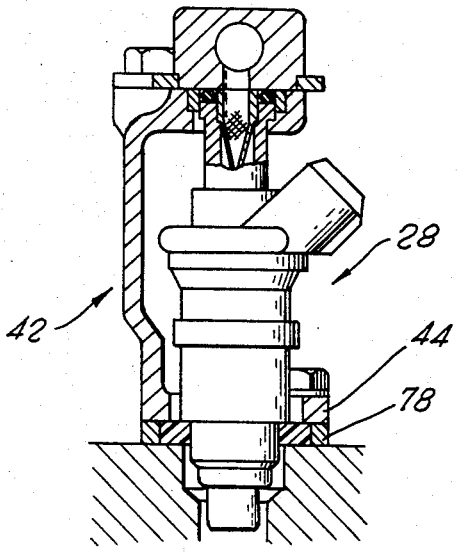
FIG. 8 is a fragmentary side view, partially broken away, illustrating an additional modification of the device of FIG. 1.
Figure 9:
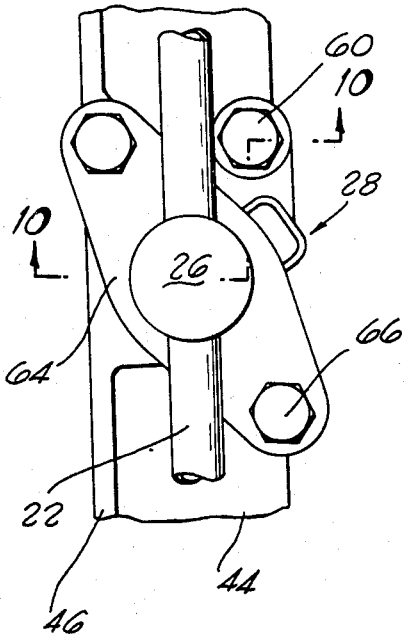
FIG. 9 is a top plan view illustrating the device of FIG. 8.
Figure 10:
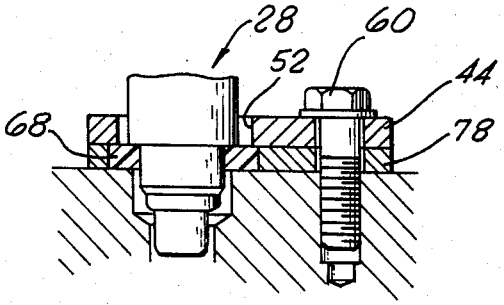
FIG. 10 is a fragmentary vertical sectional view taken along line 10—10 of FIG. 9.

Looking next to FIGS. 8–10, another modification of the device is illustrated. This modification is characterized by the joint between the engine and the mounting structure being of increased heat insulation. Again, a majority of the elements in this embodiment are substantially identical in construction with those of the preceding embodiments and identical reference numbers are employed. However, the lower portion of the mounting structure 42 has been deleted below the shoulder and instead, a ceramic or synthetic resin material is employed. This material forms a liner 78 beneath the base 44 which is resistant to heat flow therethrough. The sealing member 68 is positioned as in the first embodiment. The liner 78 is so constructed as to provide a larger hole than the hole 52 through the base 44. This creates a shoulder for maintenance of the seal 68. The same relative dimensions are incorporated as with the first embodiment. Thus, the liner 78 is slightly thinner than the axial dimension of the seal 68 to place the seal 68 in compression upon assembly. The seal 68 is also in interference fit with both the fuel injection nozzle 28 and the liner 78.

Thus, a device for mounting a fuel injection system and particularly the fuel injection nozzles thereof is here disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A device for mounting fuel injection nozzles and a fuel supply manifold for the nozzles to an engine, the nozzles each being of a type having upper and lower mounting surfaces perpendicular to the axis of the nozzle, comprising a mounting structure of unitary construction having first and second coaxial, rigidly spaced holes for receipt of one fuel injection nozzle therein;

first attachment means for fixing said mounting structure to the engine;

second attachment means for fixing the fuel supply manifold to said mounting structure;

first and second seals positioned in said first and second holes respectively on the lower and upper mounting surfaces of the nozzle, said mounting structure being sized to compress said seals between the fuel supply manifold and the engine when assembled therewith, said first hole including a first shoulder in a plane perpendicular to the axis of said first hole facing away from said second hole, said first seal being resilient and extending from said first shoulder to beyond the end of said hole for compression of said first seal when said mounting structure is assembled with the engine and said first shoulder including a step in the surface of said first hole and a washer positioned at and retained by said step, said first seal abutting against said washer.

2. The device of claim 1 wherein said first shoulder is located relative to said second hole such that said second seal is placed in compression by forced movement of said first seal against said first shoulder upon assembly.

3. The device of claim 1 wherein there are a plurality of said first holes and a plurality of said second holes to accommodate multiple fuel injection nozzles.

4. The device of claim 1 wherein said first seal is in interference fit with said first hole.

5. The device of claim 4 wherein said first seal is sized to be in interference fit with the fuel injection nozzle.

6. The device of claim 5 wherein said first seal includes recesses formed in the periphery of said seal.

7. The device of claim 1 further comprising a tubular member fixed to the end of the fuel injection nozzle positioned in said second hole, said tubular member extending from the end of the injection nozzle a distance less than the thickness of said second seal.

8. The device of claim 1 wherein said first attachment means includes fasteners fixing said mounting structure to the engine and said second attachment means includes attachment flanges fixed to the fuel supply manifold and fasteners for fastening said attachment flanges to said mounting structure.

9. The device of claim 1 wherein said mounting structure is of low thermal conductivity and said second hole includes a circular insert into which the fuel injection nozzle fits.

10. The device of claim 1 further comprising a filter positioned in said second hole between the fuel supply manifold and the fuel injection nozzle.

* * * * *